US009327884B2

(12) United States Patent
Stull, Sr.

(10) Patent No.: US 9,327,884 B2
(45) Date of Patent: May 3, 2016

(54) CHILD-RESISTANT FLIP-TOP CLOSURE

(71) Applicant: Gene R. Stull, Sr., Far Hills, NJ (US)

(72) Inventor: Gene R. Stull, Sr., Far Hills, NJ (US)

( * ) Notice: Subject to any disclaimer, the term of this patent is extended or adjusted under 35 U.S.C. 154(b) by 0 days.

(21) Appl. No.: 14/330,568

(22) Filed: Jul. 14, 2014

(65) Prior Publication Data

US 2016/0009463 A1 Jan. 14, 2016

(51) Int. Cl.

| | |
|---|---|
| ***B65D 47/14*** | (2006.01) |
| ***B65D 47/08*** | (2006.01) |
| ***B65D 50/00*** | (2006.01) |
| ***B65D 50/02*** | (2006.01) |
| ***B65D 50/04*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |
| ***B65D 51/00*** | (2006.01) |
| ***B65D 55/02*** | (2006.01) |
| ***B65D 50/06*** | (2006.01) |
| ***B65D 43/16*** | (2006.01) |

(52) U.S. Cl.

CPC ..... *B65D 50/06* (2013.01); *B65D 43/16* (2013.01)

(58) Field of Classification Search

CPC .. B65D 47/0842; B65D 47/14; B65D 50/045; B65D 2251/1016; B65D 50/00; B65D 50/02; B65D 50/04; B65D 2215/06

USPC ..... 215/237

See application file for complete search history.

(56) References Cited

U.S. PATENT DOCUMENTS

| | | | | |
|---|---|---|---|---|
| 3,873,006 | A * | 3/1975 | Fields | B65D 47/0842 222/153.14 |
| 3,889,852 | A | 6/1975 | Strefford | |
| 4,401,225 | A | 8/1983 | Schwaikert | |
| 5,031,784 | A | 7/1991 | Wright | |
| 5,040,691 | A | 8/1991 | Hayes et al. | |
| 5,573,127 | A | 11/1996 | Takahashi et al. | |
| 7,000,792 | B2 | 2/2006 | Arai | |
| 7,651,002 | B2 | 1/2010 | Hennemann et al. | |
| 8,292,101 | B1 | 10/2012 | Bragg et al. | |
| 8,434,639 | B2 | 5/2013 | Markert | |
| 8,807,359 | B2 | 8/2014 | Giraud et al. | |
| 2004/0011791 | A1 | 1/2004 | Oh | |
| 2006/0186077 | A1 | 8/2006 | Robinson | |
| 2010/0127021 | A1 | 5/2010 | Schantz et al. | |
| 2010/0200533 | A1 | 8/2010 | Rice | |
| 2012/0248129 | A1 | 10/2012 | Yoshida et al. | |

FOREIGN PATENT DOCUMENTS

WO 03018422 A1 3/2003

* cited by examiner

*Primary Examiner* — Fenn Mathew
*Assistant Examiner* — Andrew T Kirsch
(74) *Attorney, Agent, or Firm* — Drinker Biddle & Reath LLP

(57) ABSTRACT

A child-resistant flip-top closure including a base for engaging a container and a lid is hingedly attached to the base. A child-resistant locking mechanism inhibits opening of the flip-top closure. The mechanism includes at least one locking tab extending vertically upward from a portion of the lid and terminating in a locking lip. An actuation button is attached to the tab though a connecting rib so that the button is positioned laterally to the side of the tab. At least one barrier wall located adjacent to the actuation button, the barrier wall formed integral with the base and extending upward. The barrier wall includes a locking ledge formed on a rear side of the wall. The locking ledge is configured to engage the locking lip of the tab so as to provide an interlock between the lid and the base.

12 Claims, 3 Drawing Sheets

CHILD-RESISTANT FLIP-TOP CLOSURE

FIELD OF THE INVENTION

The invention relates to closures for bottles and containers and, more particularly, to an improved flip-top closure with a child-resistant feature.

BACKGROUND

There are a multitude of closures on the market for providing easy access to and dispensing from a container, such as a bottle. Containers with particularly hazardous materials, such a pharmaceuticals, are vulnerable to access by children which can lead to harm to the child if the child is able to open the bottle and consumes the contents. To prevent or inhibit access to a container, many closures incorporate child-resistant features that require additional actions that are necessary to disconnect or unlock the closure to permit opening. One of the most common child-resistant closures uses a cap and bottle construction that requires a user to press down on the cap while turning to cause locking tabs to disconnect. Once the locking tabs are disconnected the cap can be easily removed.

Such a press-down design is fine for removable lids. However, adding child resistant features to a flip top lid has been difficult since the lid is secured at one side and, thus, cannot be twisted to unlock tabs.

Also, many child-resistant features make the closure difficult to open for anyone with limited dexterity, such as people with arthritic conditions.

A need, therefore, exists for an improved flip-top closure with a child-resistant feature that is easy opening.

SUMMARY OF THE INVENTION

The present invention is directed to a child-resistant flip-top closure including a base for engaging a container and a lid is hingedly attached to the base. A child-resistant locking mechanism inhibits opening of the flip-top closure.

The child-resistant locking mechanism includes at least one locking tab extending vertically upward from a portion of the lid and terminating in a locking lip. An actuation button is attached to the tab though a connecting rib so that the button is positioned laterally to the side of the tab.

At least one barrier wall is located adjacent to the actuation button, the barrier wall is formed integral with the base and extends upward therefrom. The barrier wall includes a locking ledge formed on a rear side of the wall. The locking ledge is configured to engage the locking lip of the tab so as to provide an interlock between the lid and the base. This barrier wall may extend around the circumference of the cap protecting it from a child's fingers and/or teeth.

The closure is preferably made from plastic material. The connecting rib may be formed integral with the button and the tab.

In an embodiment there are two spaced apart tabs and the connecting rib extends between the tabs and attaches directly to the lid.

The actuation button may have a flat or concave contact surface suitable for depression by a user's finger.

In an embodiment there are two barrier walls, one located on either lateral side of the actuation button and in close proximity so as to inhibit the ability of a child from easily depressing the actuation button.

The locking ledge and locking lip preferably include complementary sloped surfaces to provide a mating interlock designed to restrict or inhibit the locking lip from easily sliding laterally away from the locking ledge.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of illustrating the invention, the drawings show a form of the invention which is presently preferred. However, it should be understood that this invention is not limited to the precise arrangements and instrumentalities shown in the drawings.

DESCRIPTION ON THE PREFERRED EMBODIMENTS

Figure 1:
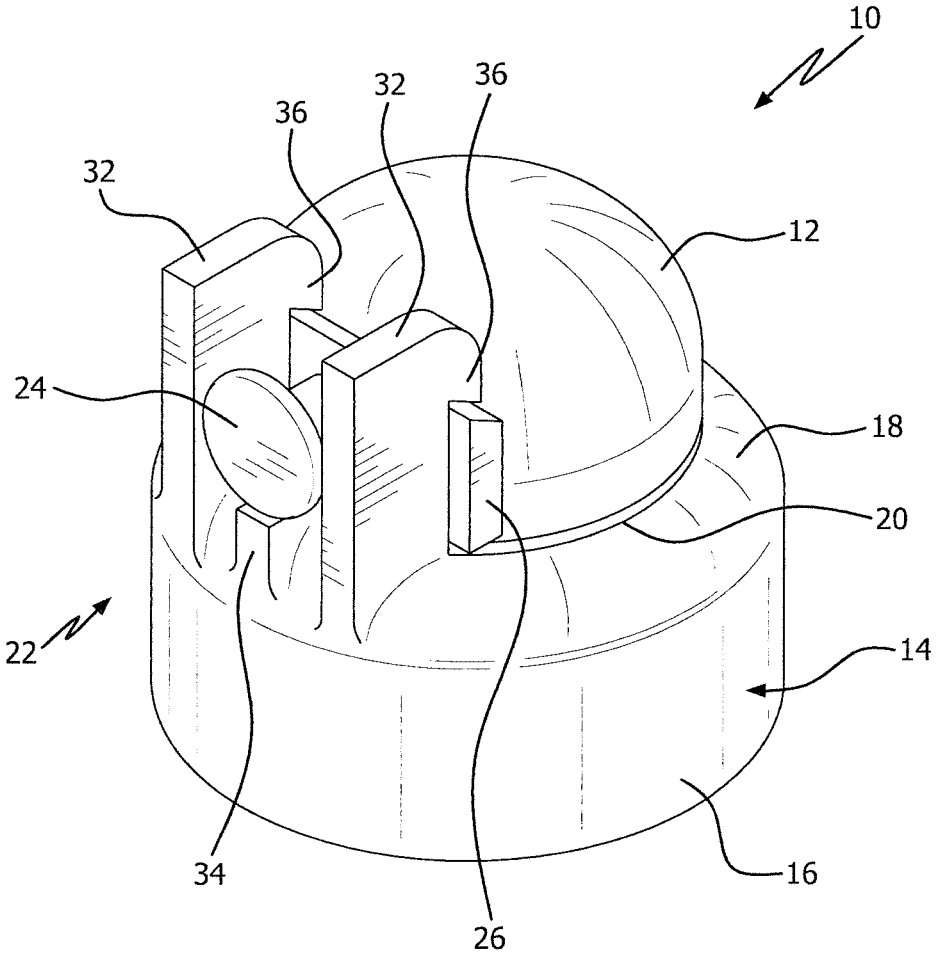
FIG. 1 is a perspective view of a flip-top closure according to the present invention with its lid in a locked position on the base.

Referring now to the figures, wherein like reference numerals represent like components throughout the views, embodiments of the invention are shown that are presently preferred. FIG. 1 is an perspective view of a child-resistant flip-top closure 10 according to the present invention. The closure 10 includes a lid 12 mounted to a base 14 through a conventional hinge (not shown). The hinge is preferably made as an integral part of the closure, i.e., a piece of material that is molded to the lid 12 and the base 14. It is also contemplated that the lid 12 could be separately attached to the base 14 using a mechanical hinge.

In the illustrated embodiment, the lid 12 is shaped as a dome. However it should be readily apparent that the invention is not limited to such a shape and any suitable shape could be used. The base 14 is shown as having a cylindrical skirt 16 with a contoured or curved upper portion 18 that connects to a top shelf 20 which includes a dispensing opening (not shown). The skirt includes conventional mechanisms for engaging the base to a bottle or container, such as threads or snap locks. Such mechanisms are well known in the art and, therefore, no further details are necessary.

The closure 10 is made from conventional plastic materials that may be used as part of an injection molding process. The container closure 10 shown in FIG. 1 is preferably formed as a one piece construction in an injection molding process.

The closure 10 includes a child-resistant locking mechanism 22 for inhibiting opening of the flip-top closure 10 by a child, while providing an easily openable top for an adult. The locking mechanism 22 includes an actuation button 24 attached to a locking tab 26 that is mounted on the lid 12. The tab 26 preferably extends vertically upward from a portion of the lid 12 ending in a locking lip 28, which in the illustrated embodiment is a sloped edge. However it is contemplated that the edge could be flat. While one tab 26 is shown in the figures, it should be apparent that there may be two spaced apart tabs formed on the lid.

Figure 3:
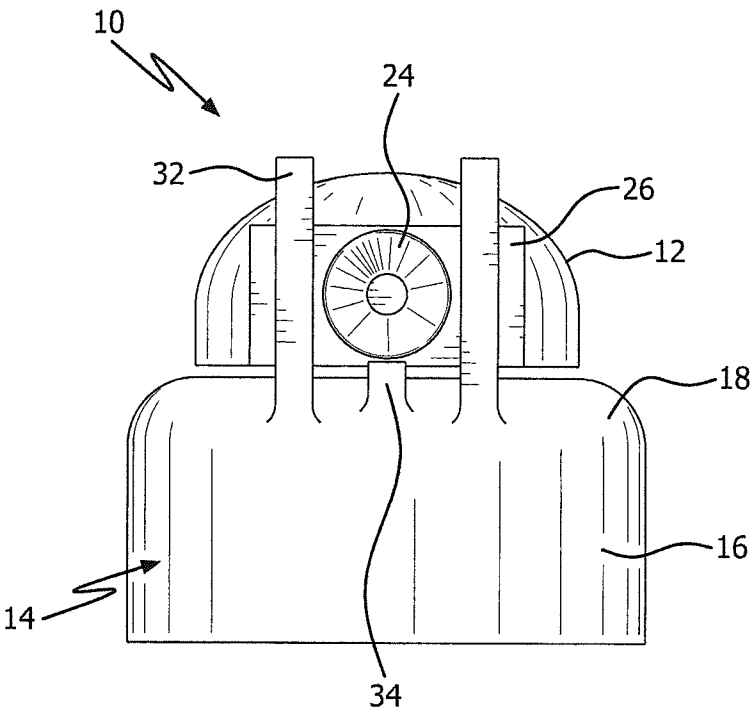
FIG. 3 is a front view of an alternate embodiment of a flip-top closure with a different shape for the actuation button.
Figure 2:
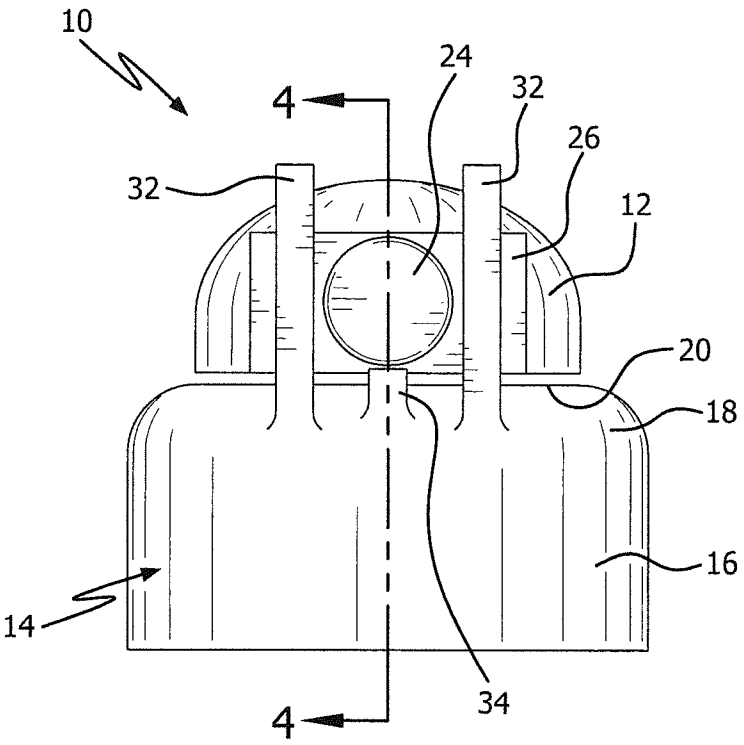
FIG. 2 is a front view of a the flip-top closure of FIG. 1 with the lid in its locked position on the base.

The actuation button 24 is preferably attached to the tab 26 through a connecting rib 30. In the illustrated embodiment, the connecting rib 30 is formed integral with the button 24 and the tab 26. However it is also contemplated that they could be separate components. As shown in FIG. 1, the actuation button may be formed with a substantially flat or planar contact surface suitable for depression by a user's finger. FIG. 3 illustrates an alternate embodiment in which the button 24 has a contoured shape, such as a curved or concave shape, which provides an added degree of protection against a child's fingers actuating the button.

The locking mechanism 22 also includes at least one, and more preferably two locking or barrier walls 32 located adjacent to the actuation button 24. In the illustrated embodiment, there are two barrier walls 32, one positioned on either side of the actuation button 24 and in close proximity so as to inhibit the ability of a child from easily depressing the actuation button. As shown, the barrier walls 32 are preferably formed integral with the base 14, and extend upward above the button 24. A third lower barrier wall 34 may be formed immediately below the actuation button to further protect the button from being inadvertently or easily depressed.

At least one of the barrier walls 32 includes a locking ledge 36 formed on the rear side of the wall 32. The locking ledge 36 is configured to engage the locking lip 28 of the tab 26 so as to provide an interlock between the lid 12 and the base 14 as will become more apparent below.

The locking ledge 36 and locking lip 28 preferably include sloped surfaces as shown to provide a mating interlock designed to restrict or inhibit the locking lip 28 from easily sliding laterally away from the locking ledge 36. Preferably the angles are complementary, such as about 45 degree angles.

Figure 4:
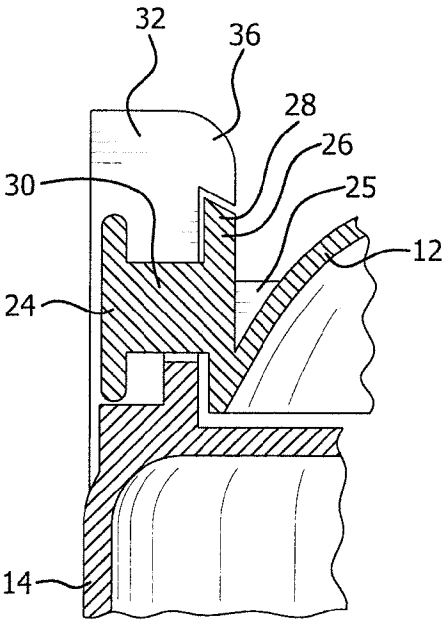
FIG. 4 is a partial section view of the flip-top closure of FIG. 2 taken along lines 4-4 with the lid in a locked position on the base.

As shown in FIG. 4, a stiffening rib 25 may be located between a back surface of the tab 26 and the lid 12. The stiffening rib 25 can be designed to adjust the inward pressure that is needed for a user to push button 24 inward.

Figure 6:
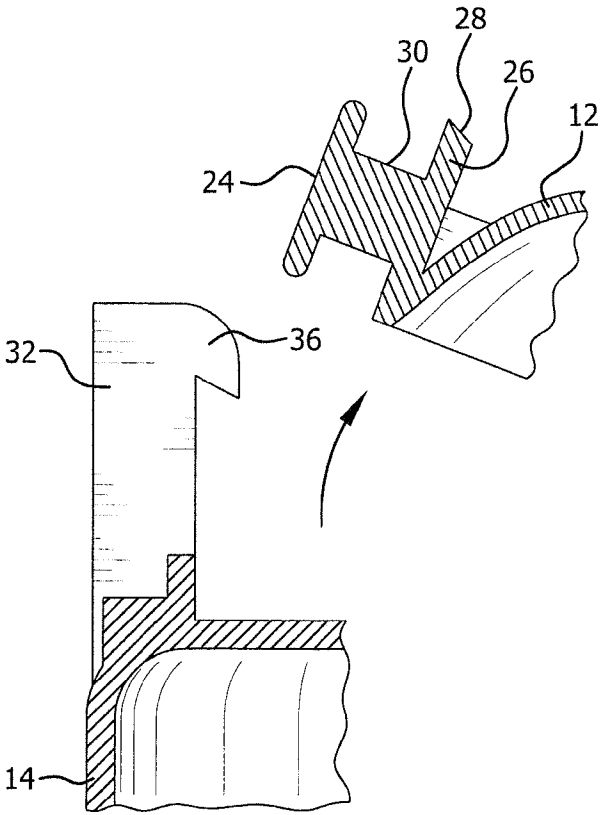
FIG. 6 is a partial section view of the flip-top closure of FIG. 4 with the lid in an open position.
Figure 5:
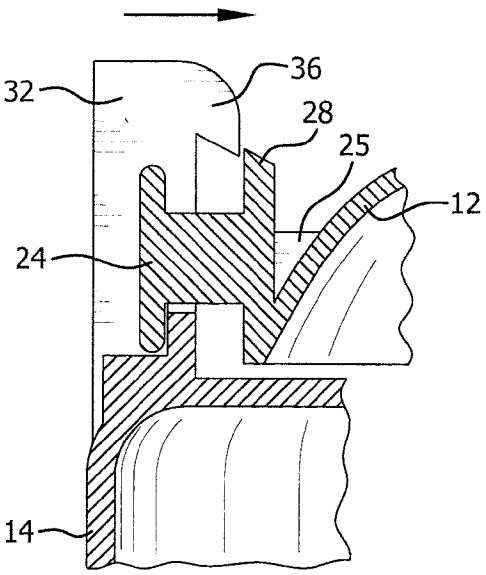
FIG. 5 is a partial section view of the flip-top closure of FIG. 4 with the lid slid into its unlocked position.

The operation of the flip-top closure is as follows. The closure 10 is illustrated in its closed and locked position in FIGS. 1 and 4. The locking ledge 36 is positioned over the locking lip 28 to restrict or inhibit the locking lip 28 from easily sliding laterally. When it is desired to open the flip-top lid 12, the user presses the actuation button 24 inward (to the right in FIG. 4) which moves the locking tab 26 inward and causes the locking lip 28 to transition out from under the locking ledge 36. This unlocked position is shown in FIG. 5. At this point there is nothing locking the lid 12 to the base 14. The user then pushes the actuation button 24 upward, causing the button 24 and the rib 30 to slide through the slot between the barrier walls 32 and the lid to pivot about its hinge. This is shown in FIG. 6.

Closing or relocking the closure simply requires that the lid to be pushed down onto the base. The barrier walls 32 preferably have a curved upper surface on the locking ledge side. The curvature of the barrier walls upon contacting the lower edge of the lid 12, cause the lid 12 to deflect laterally relative to the base 14. This results in the tab 26 being pulled inward (to the right in FIG. 5), until the locking lip 28 clears the locking ledge 36 at which point the elasticity of the lid will cause it to spring to the left and lock. Thus, the closure 10 provides for automatic locking of the lid to the base when the lid is closed.

As discussed above, the barrier walls 32 help inhibit the ability of a child to depress the actuation button, thereby providing the closure 10 with a unique child-resistant closure design.

The present invention may be embodied in other specific forms without departing from the spirit or essential attributes thereof and, accordingly, reference should be made to the appended claims, rather than to the foregoing specification, as indicating the scope of the invention.

The invention claimed is:

1. A child-resistant flip-top closure comprising:

a base having a skirt for engaging a container, and a top shelf with a dispensing opening;

a lid attached to the base through a hinge; and a child-resistant locking mechanism for inhibiting opening of the flip-top closure, the locking mechanism including:

one locking tab on the lid, the tab extending vertically upward from a portion of the lid and terminating in a locking lip, a central actuation button attached to the tab through an integral connecting rib so that the button is spaced forward of the tab, at least two barrier walls located adjacent to the actuation button, the barrier walls formed integral with the base and extending upward therefrom and on either side of the actuation button, the barrier walls terminating at or above a top of the button, each barrier wall including a locking ledge formed on a rear side of the wall, the locking ledges configured to engage the locking lip of the tab so as to provide an interlock between the lid and the base, wherein the locking tab extends laterally past the barrier walls, and wherein the locking ledges and locking lip include sloped surfaces to provide a mating interlock designed to restrict or inhibit the locking lip from easily sliding laterally away from the locking ledges, and wherein rearward pressure on the central actuation button can deflect the locking lip rearwardly into a deflected position out of engagement with the locking ledges of the at least two barrier walls, and wherein in the deflected position upward force on the central actuation button can raise and open the lid.

2. A child-resistant flip-top closure according to claim 1, wherein the closure is made from plastic material.

3. A child-resistant flip-top closure according to claim 2 wherein the connecting rib is formed integral with the button and the tab.

4. A child-resistant flip-top closure according to claim 3 wherein the actuation button has a substantially flat contact surface suitable for depression by a user's finger.

5. A child-resistant flip-top closure according to claim 3 wherein the actuation button has a contoured shape.

6. A child-resistant flip-top closure according to claim 3 wherein the at least two barrier walls are located in close proximity to the actuation button so as to inhibit the ability of a child from easily depressing the actuation button.

7. A child-resistant flip-top closure according to claim 6 wherein the locking ledges and locking lip include sloped surfaces to provide a mating interlock designed to restrict or inhibit the locking lip from easily sliding laterally away from the locking ledges.

8. A child-resistant flip-top closure according to claim 7 wherein the sloped surfaces have complementary angles.

9. A child-resistant flip-top closure according to claim 7 wherein the sloped surfaces have about 45 degree angles relative to the vertically upward direction.

10. A child-resistant flip-top closure according to claim 7 further comprising a lower barrier wall located immediately below the actuation button, extending upward from the top shelf, and formed integral with the base.

11. A child-resistant flip-top closure according to claim 7 wherein the hinge is integral with the lid and the base.

12. A child-resistant flip-top closure according to claim 11 wherein the skirt of the base is cylindrical and wherein the skirt attaches to the top shelf through a curved upper portion.

* * * * *